US007565909B2

(12) United States Patent
Reis et al.

(10) Patent No.: US 7,565,909 B2
(45) Date of Patent: Jul. 28, 2009

(54) CONCEALED OUTDOOR ENCLOSURE HAVING ONE-WAY VISIBILITY OVER A 360 DEGREE VISUAL FIELD

(75) Inventors: Michael Reis, Grand Blanc, MI (US); Scott D. Lee, Lapeer, MI (US)

(73) Assignee: Eastman Holding Company, Flushing, MI (US)

( * ) Notice: Subject to any disclaimer, the term of this patent is extended or adjusted under 35 U.S.C. 154(b) by 457 days.

(21) Appl. No.: 11/336,625

(22) Filed: Jan. 20, 2006

(65) Prior Publication Data

US 2006/0207641 A1 Sep. 21, 2006

Related U.S. Application Data

(63) Continuation-in-part of application No. 11/320,171, filed on Dec. 28, 2005, and a continuation-in-part of application No. 11/060,079, filed on Feb. 17, 2005, now Pat. No. 7,320,332.

(51) Int. Cl.
*E04H 15/54* (2006.01)
*E04H 15/48* (2006.01)

(52) U.S. Cl. ..... 135/115; 135/147; 135/901; 428/17

(58) Field of Classification Search ..... 135/90, 135/93, 115, 117, 128, 130, 135, 143–147, 135/901, 907, 98; 43/1; 428/15–18
See application file for complete search history.

(56) References Cited

U.S. PATENT DOCUMENTS 3,799,608 A * 3/1974 Smutny et al. ..... 297/184.14
3,810,482 A * 5/1974 Beavers ..... 135/147
4,323,605 A * 4/1982 Rush ..... 428/17
4,375,488 A 3/1983 Hogan
4,517,230 A 5/1985 Crawford
4,825,578 A * 5/1989 Robinson ..... 43/1
4,931,320 A * 6/1990 Leonard ..... 428/17
5,281,451 A * 1/1994 Reynolds ..... 428/17
5,377,711 A 1/1995 Mueller
5,528,849 A * 6/1996 Plinta ..... 43/1
5,628,338 A * 5/1997 Stumbo ..... 135/147
6,202,665 B1 * 3/2001 O'Hare ..... 135/90
6,510,922 B1 * 1/2003 Hodnett ..... 182/187
6,675,394 B2 1/2004 Egnew
6,701,948 B2 3/2004 Jopp et al.

(Continued)

*Primary Examiner*—Winnie Yip
(74) *Attorney, Agent, or Firm*—Carrier, Blackman & Associates, P.C.; William D. Blackman; Joseph P. Carrier

(57) ABSTRACT

A portable outdoor enclosure includes a support frame and a three dimensional camouflage cover having a bi-layer construction that provides a high degree of unidirectional visibility. The cover includes an outer layer and an inner layer, the outer layer comprising a plurality of partial cutouts, the cutouts formed with a curvilinear incision pattern which are partially separable from the inner layer, the outer layer is attached to the inner layer at a plurality of spaced locations, and wherein the exterior-facing surfaces of both the outer layer and the inner layer are printed in a camouflage pattern and coloration. The inner layer of the cover includes a mesh upper portion permitting a high degree of outward visibility therethrough over a 360 degree horizontal visual field, and an opaque lower portion.

10 Claims, 19 Drawing Sheets

U.S. PATENT DOCUMENTS 6,735,781 B1 5/2004 Fulmer
6,787,212 B2 * 9/2004 Strength et al. ..... 428/102
6,941,961 B1 * 9/2005 Eastman, II ..... 135/121
7,182,091 B2 * 2/2007 Maddox ..... 135/90
7,225,823 B1 * 6/2007 Ransom et al. ..... 135/126
2002/0069904 A1 * 6/2002 Robinson ..... 135/87

* cited by examiner

CONCEALED OUTDOOR ENCLOSURE HAVING ONE-WAY VISIBILITY OVER A 360 DEGREE VISUAL FIELD

CROSS-REFERENCE TO RELATED APPLICATION

This application is a continuation in part of, and claims priority under 35 USC 120, from U.S. patent applications Ser. No. 11/060,079, filed on Feb. 17, 2005 now U.S. Pat. No. 7,320,332 and Ser. No. 11/320,171, filed on Dec. 28, 2005.

BACKGROUND OF THE INVENTION

1. Field of the Invention

The present invention relates to portable shelters and similar outdoor enclosures, for providing a hidden location for a hunter or naturalist to occupy in the field, while observing or waiting for game or other wildlife. More particularly, the present invention relates to a novel concealment camouflage covering having intact and unopened sidewall panels that permit 360 degree outward visibility and "shoot through", while substantially preventing the occupant from being seen from the exterior.

2. Description of the Background Art

When out in the field for moderate or long periods, hunters often spend time in hunting blinds to disguise themselves from game. However, a problem arises because a hunting blind or shelter is an unnatural object, and its unusual shape and colors tend to make it stand out when viewed by game. As a result, game generally avoids the blind or shelter, and the hunter's position is compromised.

Similarly, naturalists, nature photographers, and environmental scientists often work out in the field, such as in forest or wilderness areas. Naturalists often wish to approach and view wild animals as closely as possible without being detected, in order to photograph or observe the animals in their natural habitat, while disturbing them as little as possible. Accordingly, these people also find it useful to disguise their presence while also being sheltered from the elements of nature.

Hunting blinds having a number of different properties are known in the art. Class 135, subclass 901 is provided in the U.S. Patent Classification System for the listing of hunting blinds and ice fishing shelters. The following patents detail of some of the most relevant art.

Rush, U.S. Pat. No. 4,323,605, discloses a camouflage material having V-shaped incisions. When the material is stretched, the V-shaped sections extend out off the flat surface of the material creating a 3-D effect. This patent argues that the prior art that used U shaped incisions provided too much visibility and therefore too little concealment. Illustrations included with this patent demonstrate a hunting blind covered in the subject material having a defined window area.

Leonard, U.S. Pat. No. 4,931,320 discloses a construction for camouflage in which a camouflage fabric is sewn to an open mesh substrate along plural spaced lines of attachment. Between the lines of attachment, the camouflage fabric is cut to form plural lobes having a three dimensional simulation of natural objects such as leaves. Leonard discloses both the fabric sheet and net substrate comprising a camouflage pattern.

Numerous manufactures produce hunting blinds marketed as "shoot-though." However, these blinds include defined window areas which are the only areas having the shoot-though property.

Mueller, U.S. Pat. No. 5,377,711, discloses a hunting blind without flap windows. Mueller's blind is composed of a frame enclosed by a casing and netting. The casing is provided on the back, ceiling, and two opposed lateral sides of the blind. The casing is not disclosed to have openings, and is described as being impervious to visible light. The front wall of the blind is covered by netting which is camouflaged with camouflage coloration patches and permits penetration of an arrow or bullet, or "shoot through". Thus, the front wall of the blind defines the viewing area.

Stumbo, U.S. Pat. No. 5,628,338, discloses a portable and collapsible blind or shelter which includes an integral fabric cover having four side walls and a top. Each side wall includes at least one window. One corner of the structure includes a vertical opening to permit ingress and egress from the structure. Each side wall, and the top, is supported in a taut condition by a support member having four resilient and flexible legs connected to a central hub. The legs can pivot away from the hub to collapse the blind structure.

Although the known devices are useful for their intended purposes, a need still exists in the art for an improved outdoor enclosure useable as a hunting blind or observation station. A need also exists for an outdoor enclosure having an improved visibility range and shoot-though design.

SUMMARY OF THE INVENTION

The present invention provides a portable hunting blind or similar enclosure, to provide concealing cover to a hunter in the field. The portable enclosure includes a three dimensional (3-D) camouflage which provides a high degree of unidirectional (outward) visibility over a 360 degree range through sidewalls that are intact and unopened. As a result, although window openings are provided, such window areas are not necessary for outward visibility. The enclosure according to the present invention also provides "shoot through" capability over the entire viewing range.

The portable enclosure according to the present invention includes a ceiling and a plurality of walls forming a closed-wall structure. The entire structure is formed of a three dimensional camouflage such that when viewed from the exterior, the walls are substantially opaque, and an occupant of the interior is hidden from view. When an occupant of the interior views outwardly, at least the upper portions of the walls are substantially transparent. The walls include at least one door opening and plural window openings, the openings formed in the upper portion, the lower portion, or extending across both the upper and lower portions. The openings are selectively opened or closed by fastening means provided along the peripheral edges thereof.

A support frame comprising support members selectively assemble to form a structure capable of fully enclosing an occupant, and collapse and disassemble for transport and storage. The support frame includes plural separate, independent sub-frames having a hub-and-strut configuration. A sub-frame is disposed on each sidewall and on the ceiling. Each sub-frame is provided with a central hub having four struts or support poles extending therefrom. By using a hub-and-strut frame that is larger than the dimension of a sidewall, the struts can be bowed outwardly from the natural plane of the sidewall to a self-supporting locked position thereby providing tension to the sidewall. Such a configuration provides a rapidly deployable enclosure having a substantially cubic shape.

In all of the disclosed embodiments of the invention, the three-dimensional elements of the camouflage are partial cut-outs in an outer layer of camouflage fabric that is attached to a continuous, non-cut substrate. Both the outer layer and substrate are printed in a camouflage pattern and coloration. The partial cutouts are formed with a realistic incision pattern resembling tree leaves. The partial cutouts dangle off of the face of the covering providing the 3-D effect.

The outer layer is formed of a conventional durable fabric such as a rip-stop nylon. In portions of the enclosure which are opaque, the substrate is a similar durable fabric. In portions of the enclosure which permit outward viewing, the substrate is formed of a mesh. In particular, the mesh is of a size and thickness which permits "shoot through" of the discharge of a hunting weapon such as a bow or gun.

Accordingly, it is an object of the present invention to provide a portable hunting blind or similar enclosure a three dimensional camouflage which provides a high degree of unidirectional (outward) visibility through the intact and unopened sidewalls over a 360 degree range and also provides "shoot through" capability over the entire viewing range.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
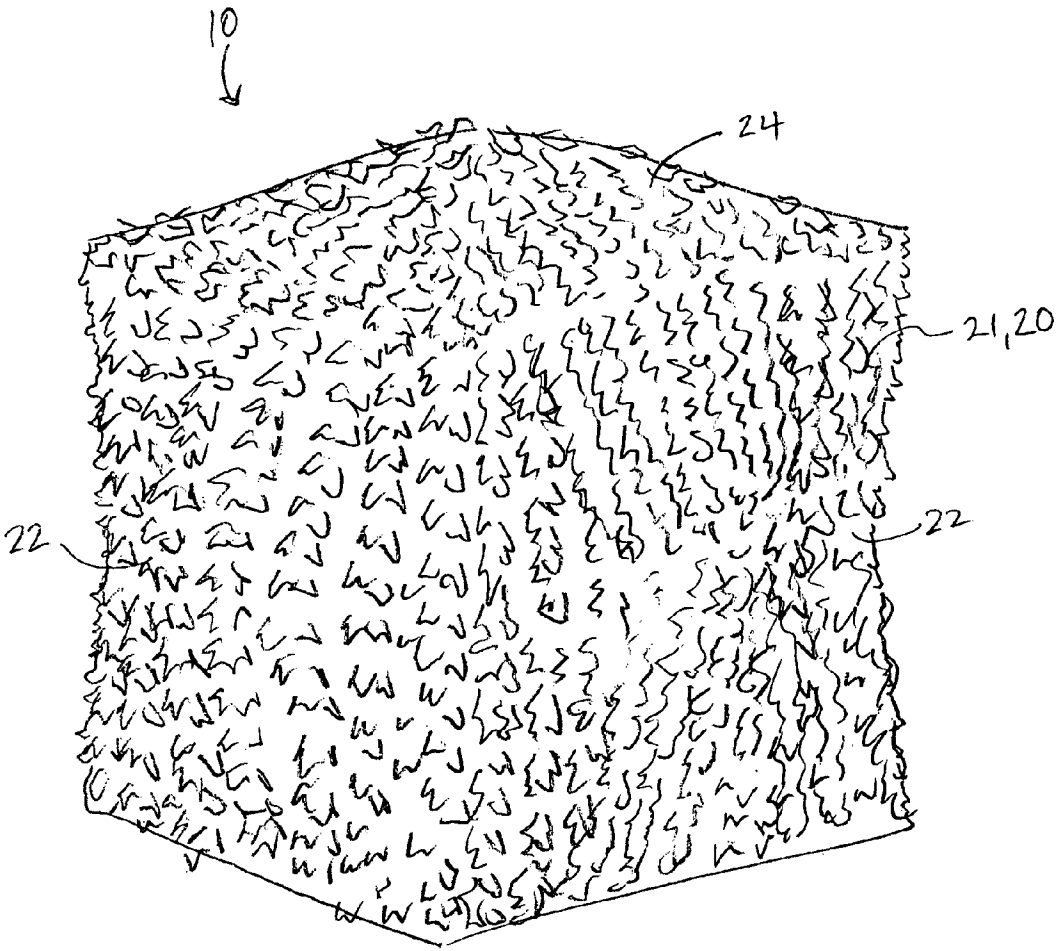
FIG. 1 is an elevated perspective view of the assembled portable outdoor enclosure with the 3-D camouflage cover thereon, providing a structure that permits an occupant of the structure a 360 degree range of outward view, while preventing the occupant from being seen from the exterior of the structure.
Figure 1B:
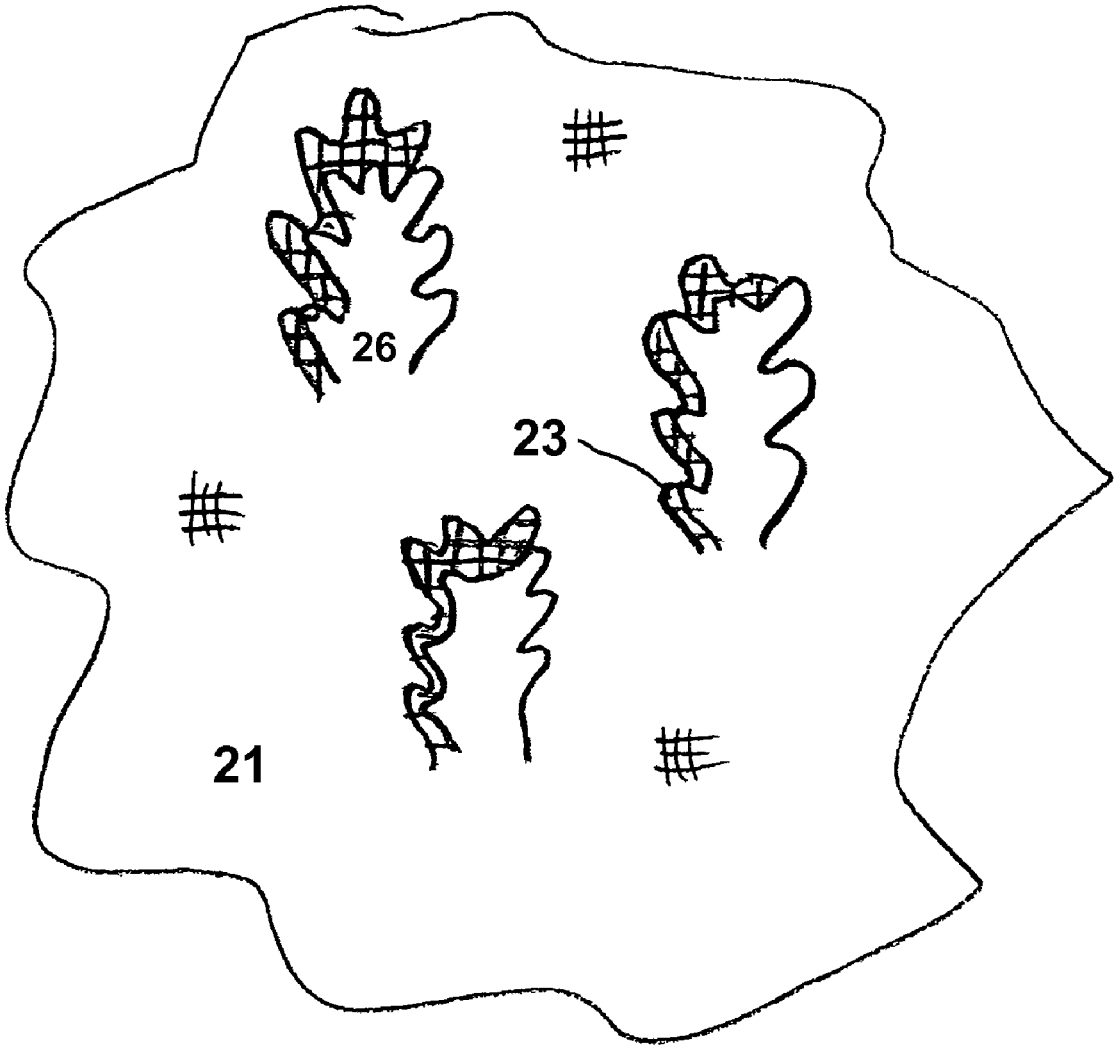
FIG. 1B is a detail view of a portion of the 3-D camouflage cover of FIG. 1, showing a multi-layer construction thereof including an inner layer and an outer layer.

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art.

The portable enclosure 10 according to the present invention includes a ceiling 24 and a plurality of sidewalls 22 forming a closed-wall structure. The entire structure is formed of a three dimensional bi-layer camouflage cover 20 (FIG. 1) which renders the walls substantially opaque when viewed from the exterior, whereby an occupant of the enclosure 10 is hidden from view. The cover 20 is configured such that when viewed outwardly from the interior of the enclosure 10, the upper portions 25 of the sidewalls 22 are semi-transparent, and the ceiling 24 and lower portions 27 of the sidewalls 22 are opaque.

Figure 2:
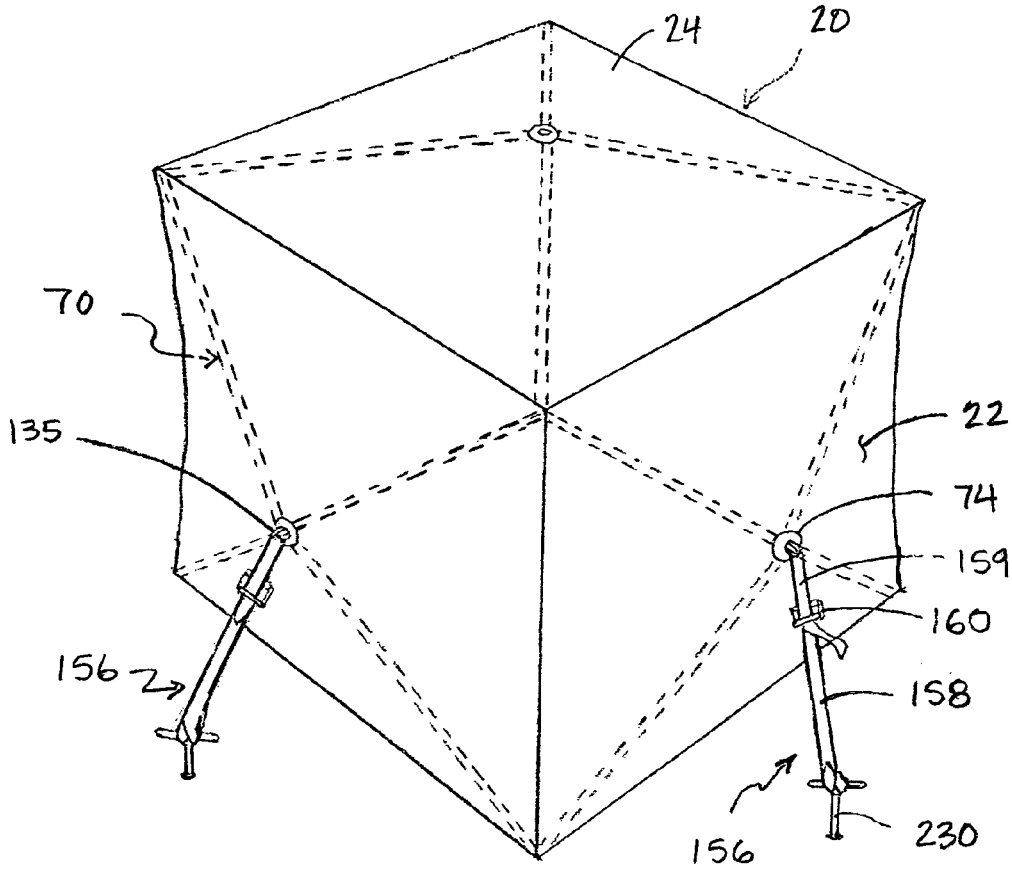
FIG. 2 is an elevated perspective view of the assembled portable outdoor enclosure of FIG. 1, showing the covering as a diagrammatic outline and showing some internal sub-frames in phantom, and in which adjustable length cinch straps are used to secure the hub portion of each sub-frame to the substrate.
Figure 3:
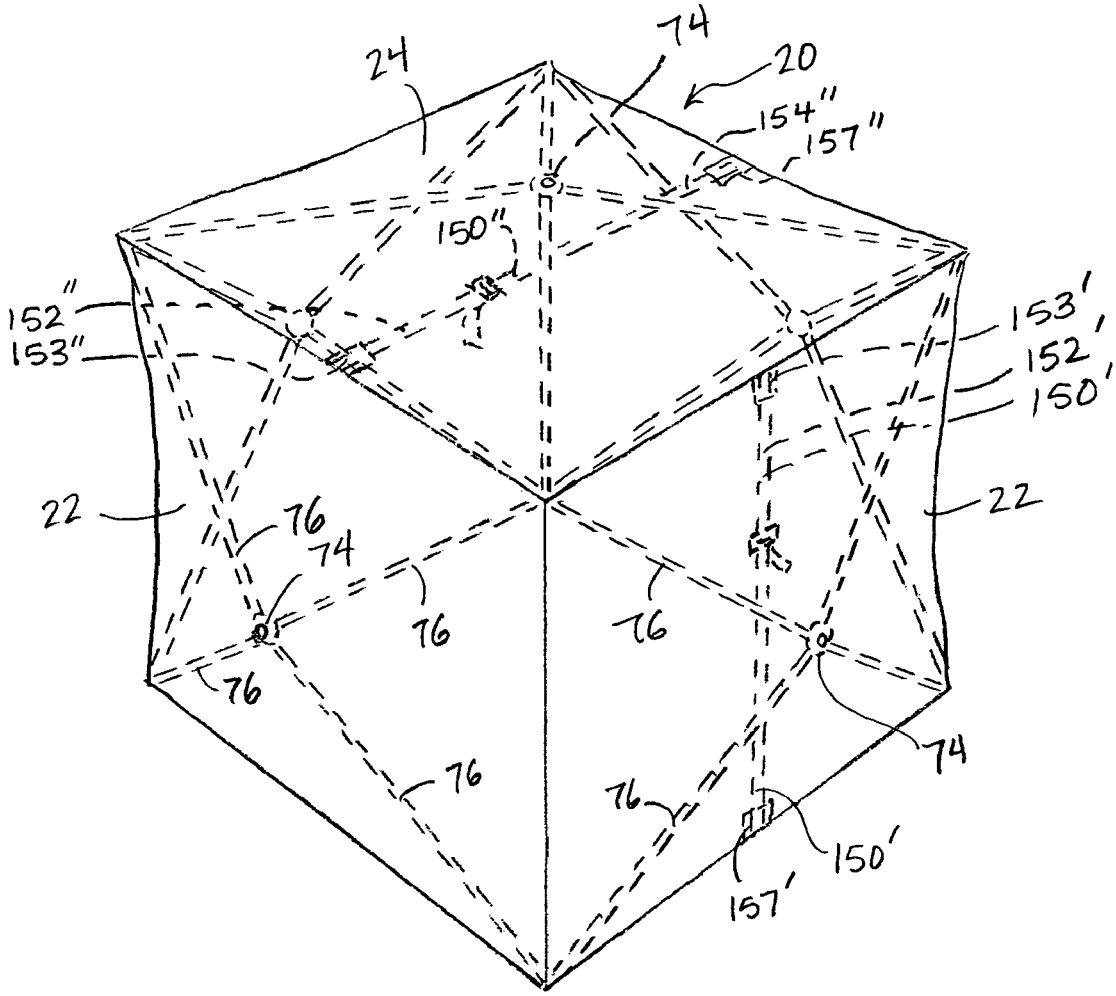
FIG. 3 is an elevated perspective view of the assembled portable outdoor enclosure of FIG. 3, showing the covering as a diagrammatic outline and showing the internal sub-frames and tensioning straps in phantom.

As shown in FIGS. 2 and 3, in a fully assembled configuration thereof, a portable enclosure 10 according to the selected embodiment includes a flexible outer covering, or shell, 20 supported by a frame 70. The portable enclosure 10 is free standing, but is also configured to permit securement to the underlying surface 5 using a plurality of adjustable straps 156 and anchor stakes 230. The underlying surface 5 may represent the ground, a platform or boat deck. It addition, it is well within the scope of this invention for the portable enclosure to be used on ice surfaces such as frozen lakes.

The covering 20 is cooperatively supported by, and overlies the frame 70. The covering 20 includes a plurality of interconnected sidewalls 22 and a ceiling 24. The sidewalls 22 are arranged in a lateral edge-to-edge relationship, such that each of the sidewalls 22 is joined to an adjacent sidewall at each of its respective lateral edges to form a closed section. The ceiling 24 is joined at its peripheral edges to the respective upper edges of the sidewalls 22, whereby the upper end of the portable enclosure 10 is closed. In the assembled configuration of the enclosure 10, the sidewalls 22 extend substantially vertically upwardly, with each sidewall bowed slightly outwardly by its respective sub-frame 72 (FIG. 3).

In all embodiments illustrated herein, the portable enclosure 10 is shown having four sidewalls 22. However, it is within the scope of the invention to configure the portable enclosure 10 so as to have only three sidewalls, or more than four sidewalls. For example, for a larger enclosure, five or six sidewalls may be provided.

The lower end of the portable enclosure 10 may be left open to allow the user to have access to substantially the entire ground surface area within the surrounding sidewalls. Alternatively, if desired, a bag used to house and store the enclosure 10 in a collapsed configuration thereof may be adapted to be used as a floor in the assembled configuration of the enclosure 10, to cover part or all of the floor area inside of the enclosure 10.

Covering

In all of the disclosed embodiments of the invention, the covering 20 of the enclosure 10 is a unitary body configured to provide four sidewalls 22 and a ceiling 24. The covering 20 provides an outer shell for the portable enclosure 10, and is formed of a bi-layer flexible sheet material. In the illustrated embodiment, each layer of the bi-layer flexible sheet material is a woven synthetic fabric to provide the durability, flexibility and strength required for use in harsh environmental conditions.

The covering 20 includes a three-dimensional camouflage outer layer 21 (FIG. 1). The three-dimensional elements of the camouflage are partial cutouts 26, formed in an outer layer of camouflage fabric. The camouflage outer layer 21 is attached to a non-cut inner layer 23. In the outer layer 21, the partial cutouts 26 are formed with a realistic curvilinear incision pattern resembling tree leaves. The partial cutouts 26 of the outer layer 21 may curl along the periphery thereof and dangle off of the face of the inner layer 23, providing a desirable 3-D effect. This effect is enhanced in breezy conditions, since the free ends of the partial cutouts 26 move freely relative to the inner layer 23. The outer layer 21 is formed of a conventional durable closely-woven fabric such as a rip-stop nylon.

In a preferred embodiment, the outer layer 21 extends over the entire exterior surface of the enclosure 10 and is attached to the inner layer 23 at a plurality of spaced locations. The outer layer is attached to the inner layer 23 by known methods including, but not limited to, sewing or adhesive bonding.

The exterior-facing surfaces of both the outer layer 21 and inner layer 23 are printed in a camouflage pattern and coloration.

Figure 4:
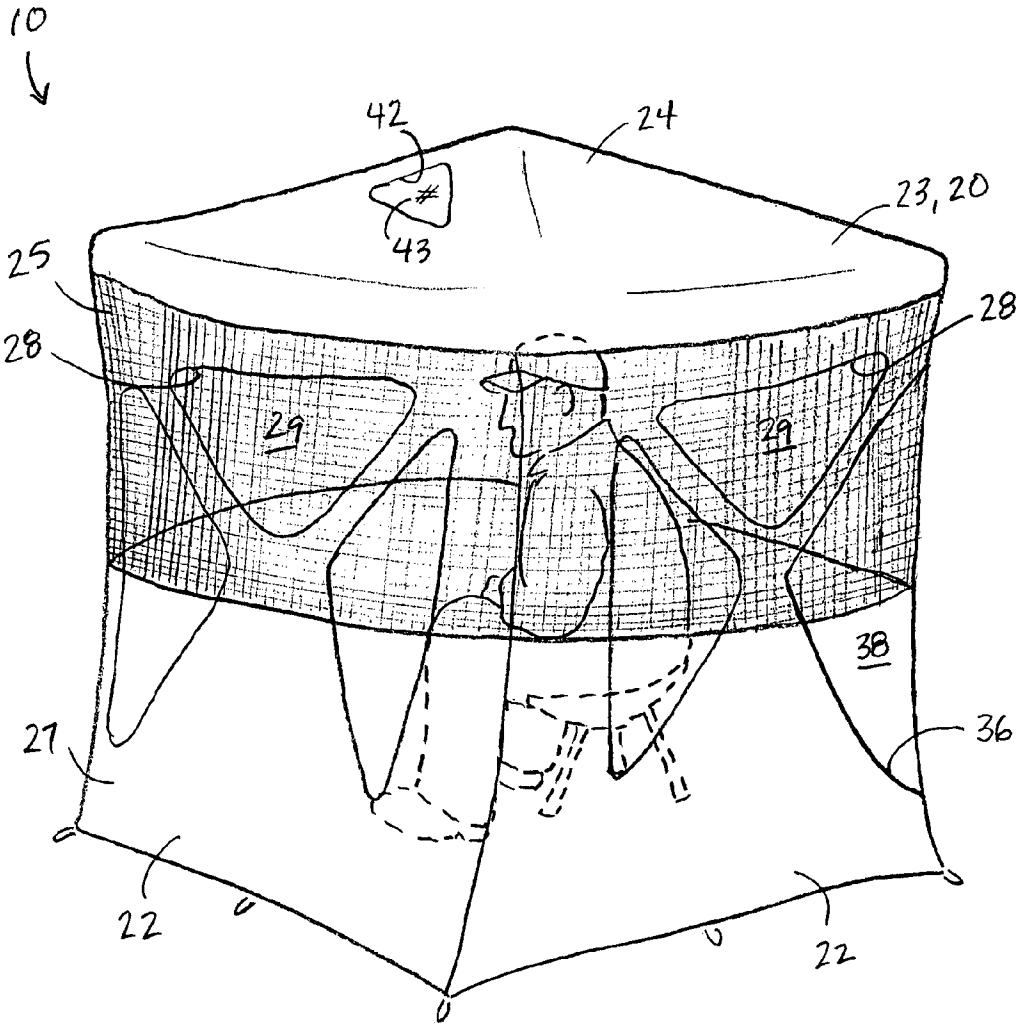
FIG. 4 is an elevated perspective view of a first embodiment of the assembled portable outdoor enclosure of FIG. 1, showing the substrate of the cover with the outer layer omitted, revealing the upper portions of the sidewall formed of a frangible mesh which permits a 360 degree range of outward view in the horizontal plane as well as shoot through capability.

The cover 20 is shown in FIG. 4 with the outer layer 21 deleted for the purpose of illustrating the configuration of the inner layer 23. However, it is understood that in actual use, the outer layer 21 and inner layer 23 are permanently fixed to one another at a plurality of locations.

As seen in FIG. 4, the inner layer 23 comprises a substantially transparent upper portion 25 which substantially extends over the upper half of the sidewalls 22. The upper portion 25 is rendered slightly less transparent when the camouflage outer layer 21 is superimposed on the inner layer 23. However, when the outer layer 21 is superimposed on the inner layer 23, the size and shape of the partial cutouts of the outer layer 21, the tendency of the free edges of the partial cutouts to separate from the inner layer, and the spacing of the attachment locations of the outer layer 21 to the inner layer 23 all cooperate to permit a high degree of outward visibility, as viewed from the interior of the enclosure 10. In addition, these same features, along with the common use of camouflage print on exterior-facing surfaces of both the inner 23 and outer 21 layers, all cooperate to substantially prevent visibility of the interior of the enclosure when viewed from the outside thereof.

The upper portion 25 is formed of a frangible mesh (loosely woven fabric) such as a screen having a filament size, thickness, and spacing which is substantially visually transparent and which permits "shoot through" of the discharge of a hunting weapon such as a bow or gun. The upper portion 25 extends continuously across the perimeter of the sidewalls 22 to provide a portable enclosure 10 having a high degree of unidirectional (outward) visibility over a 360 degree horizontal range, and also provides "shoot through" capability over the entire viewing range.

The inner layer 23 also includes a lower portion 27 which extends between the upper portion 25 and the lower edge of the cover 20. The lower portion 27 is opaque, and formed of a conventional durable, tightly woven fabric such as a rip-stop nylon. To ensure the opacity of the lower portion 27, the lower portion 27 may be formed of an opaque synthetic fabric of a heavier weight than that used to form the outer layer 21.

In the illustrated embodiment, the lower, opaque portion 27 extends over approximately the lower half of each sidewall. It will be understood by those skilled in the art, however, that the proportions of transparent upper portion to opaque lower portion may be varied as long as a high degree of outward visibility for an occupant who is seated or standing within the enclosure 10 is maintained. For example, the lower portion 27 may be provided on a smaller proportion of the sidewall area so as to cover approximately the lowest one third of each sidewall such that the upper portion covers approximately the upper two thirds of each sidewall.

The ceiling 24 is continuous with the upper edge of the mesh upper portion 25, and includes the three-dimensional camouflage outer layer 21 attached to an opaque inner layer 23 in a manner similar to that of the lower portion 27. Use of an opaque portion for the enclosure ceiling 24 prevents rainfall from entering the enclosure, and also ensures that the interior of the enclosure is shaded, further improving overall camouflage effect of the enclosure 10.

At least one window opening 28 may be disposed on one or more of the sidewalls 22. Each window opening comprises a window flap which is releasably connected about its peripheral edge to the corresponding sidewall 22. For example, a zipper may be provided along the peripheral edge of the window opening 28 to permit selective opening and closure of the window opening 28. The window openings 28 may be formed in the upper portion, the lower portion, or extending across both the upper and lower portions. The window opening 28 extends through both layers 21, 23 of the cover 20 so that when the window opening 28 is opened, the space within the window opening is vacant, and a single flap 29 is formed of the bi-layer fabric cover 20.

Although the inventive portable enclosure 10 is illustrated as having a plurality of window openings 28, it should be understood that outward visibility over a 360 degree range is unrelated to the number of window openings 28, and/or whether the window openings 28 are open or closed. Rather, outward visibility over a 360 degree range through intact and unopened sidewalls 22 is achieved as a result of the full-surround configuration of the upper portion 25.

The portable enclosure 10 includes at least one selectively closable door opening 36 formed in a sidewall 22, to permit ingress into, and egress from the enclosure 10. In the depicted embodiment, the door opening 36 is a closable door flap 38 that is secured to the sidewall 22 using conventional door closure means 40, which may include, but is not limited to, hook and loop fasteners, zippers, snaps, or ties. The door opening 36 is of sufficient size to extend across both the upper portion and the lower portion of the covering. Like window opening 28, the door opening 36 extends through both layers 21, 23 of the cover 20 so that when the door opening 36 is opened, the space within the door opening is vacant, and a single flap 38 is formed of the bi-layer fabric cover 20.

A vent opening 42 may be formed in the ceiling 24, and comprises a breathable vent insert 43 sewn therein which prevents environmental precipitation from entering into the interior of the enclosure 10, and which also allows adequate ventilation of the structure. The vent opening 42 may include a closable flap of fabric on the interior of the covering 20, and a screen panel may be provided as the vent insert 43.

Frame

Figure 5:
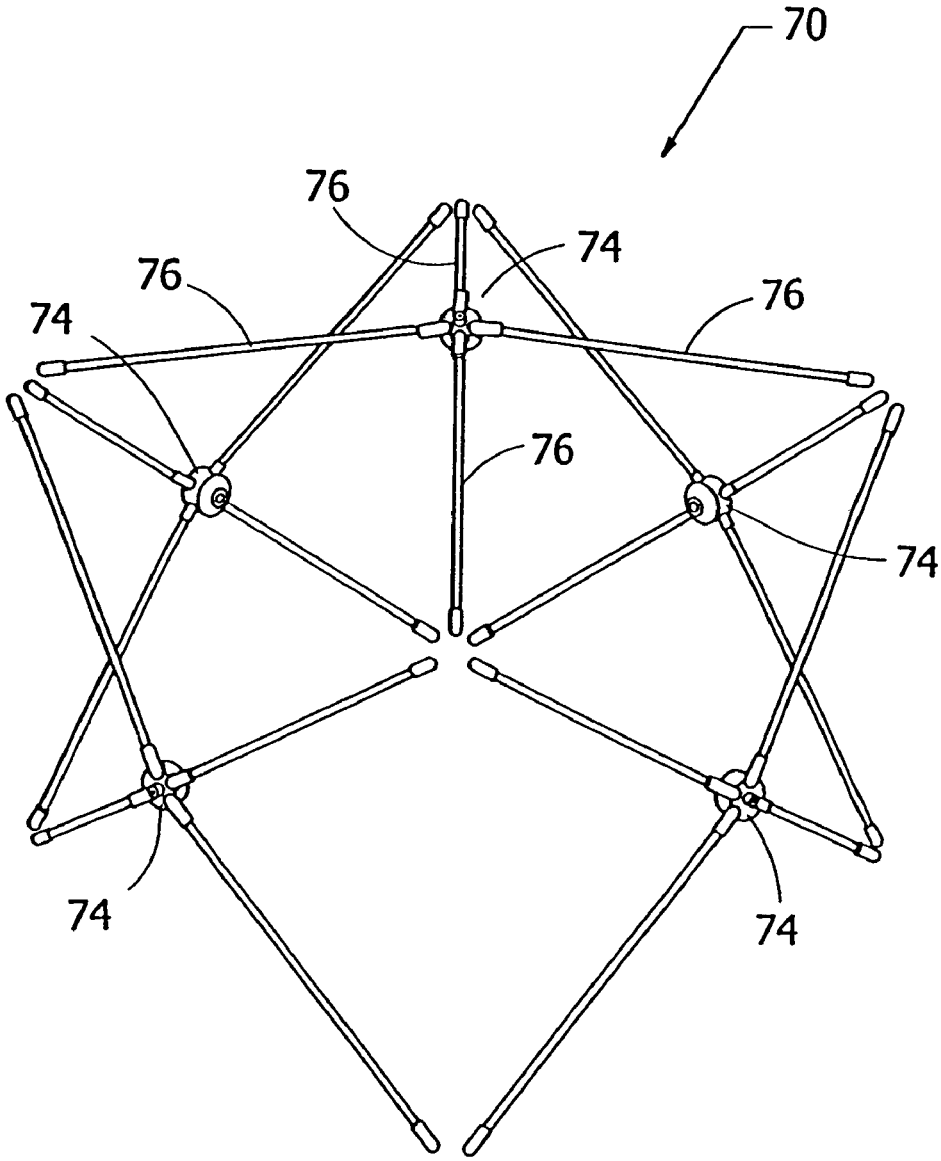
FIG. 5 is an elevated perspective view of the internal frame structure of the enclosure of FIG. 1, with the covering deleted from the drawing for illustrative purposes.

Referring now to FIG. 5, the frame 70 cooperates with the covering 20 to provide a three-dimensional enclosure which is free standing, lightweight, and easily assembled and disassembled. In the depicted embodiment of the enclosure 10, the frame 70 includes five sub-frames 72 such that a separate sub-frame 72 is provided for the ceiling 24, and a sub-frame is also provided for each of the four respective sidewalls 22. In the illustrated embodiment, the individual sub-frames 72 are not connected to one another. When assembled with the covering 20, the individual sub-frames 72 are discontiguous with each other.

Each sub-frame 72 includes a substantially cylindrical central hub 74, and further includes a plurality of poles 76, which are pivotally mounted to the hub 74 and extend outwardly therefrom. In the illustrated embodiment, four poles 76 are provided for each hub. However, it is within the scope of this invention to provide a hub having a fewer or greater number of poles 76. For example, a fewer number of poles 76 might be required to accommodate a triangular sidewall.

Figure 6:
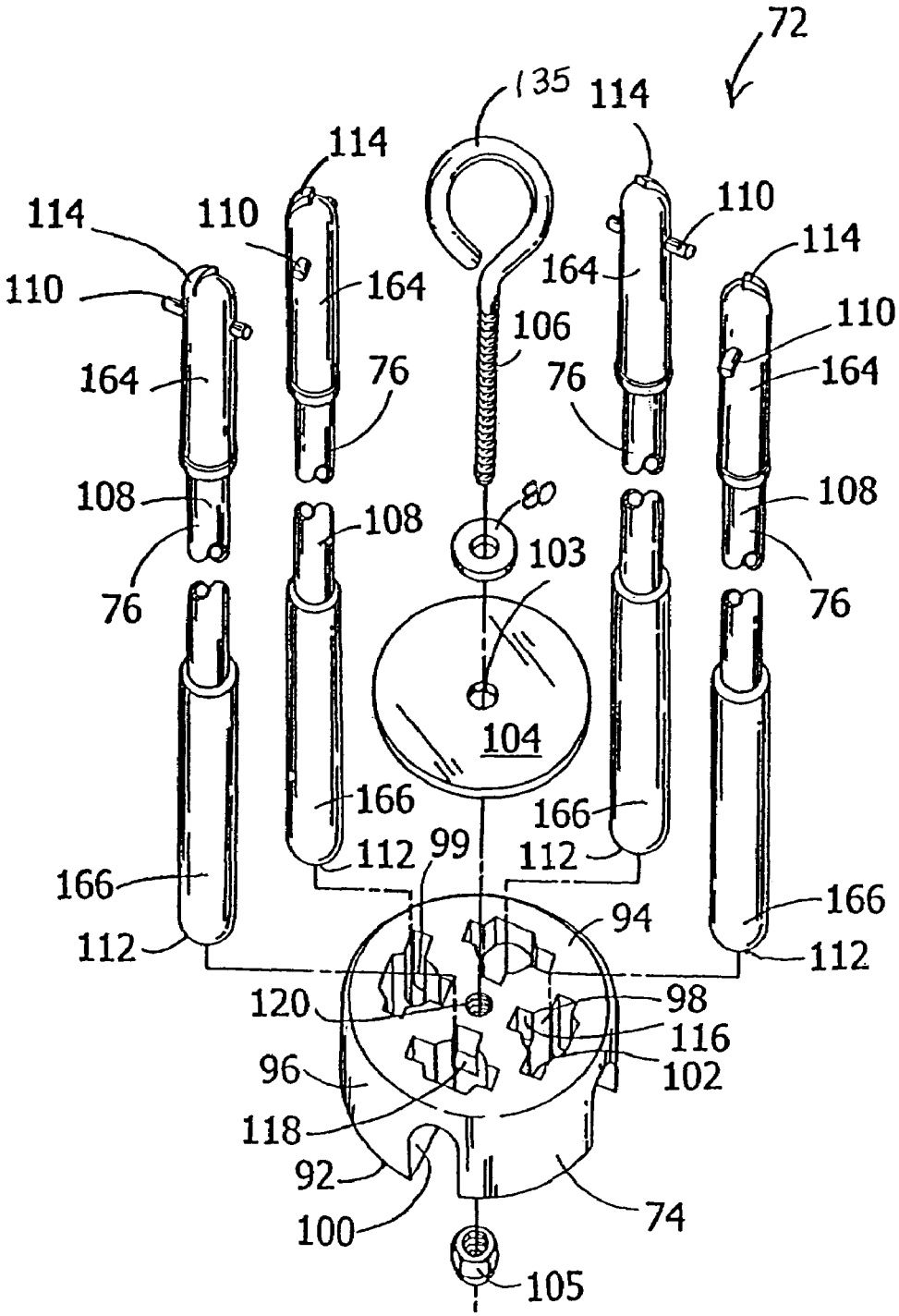
FIG. 6 is an exploded detail view showing the components of one sub-frame of the frame structure of FIG. 4 in a collapsed configuration, including the hub, the hub cap plate, and the poles.
Figure 7:
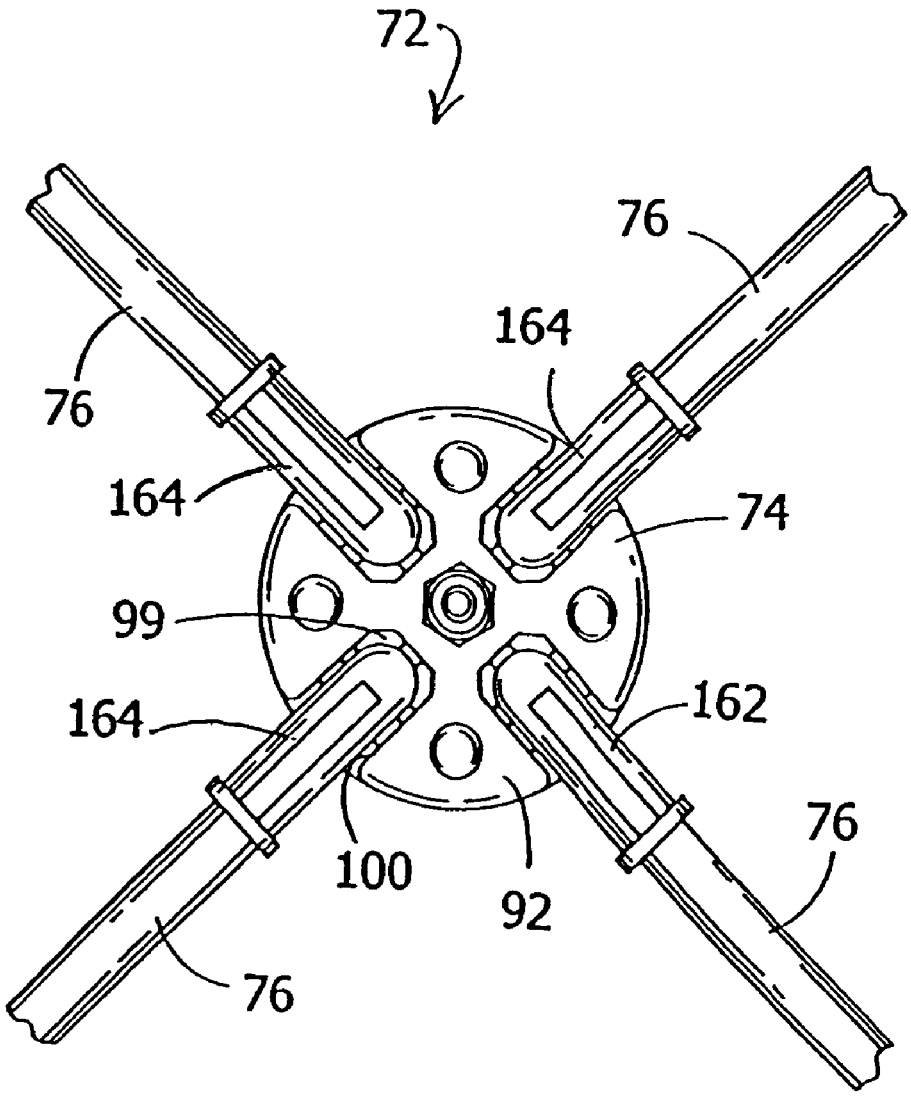
FIG. 7 is a detail view of the assembled and erected hub portion of the sub-frame of FIG. 3, viewed from a vantage point outside the shelter.

As seen in FIGS. 6 and 7, the hub 74 is a substantially cylindrical block, which is formed from a strong, substantially solid plastic or metal material having a number of openings formed therein, as will be further described. The hub 74 has an inner face 94 arranged to face toward the interior of the portable enclosure 10, and an outer face 92 which faces toward the interior surface of the covering 20, when the portable enclosure is assembled. The hub 74 has an arcuate peripheral edge surface 96 extending between the inner face 92 and the outer face 94.

The hub 74 also has a plurality of mounting apertures 98 formed therein. One mounting aperture 98 is provided for each pole 76. The mounting apertures 98 are positioned so as to surround, and be equidistantly spaced about, the axial centerline of the hub 74. Each mounting aperture 98 includes a shaped through hole 99 and a radial groove 100 extending from a respective through hole 99. The through holes 99 extend through the block of the hub 74, between the inner face 92 and the outer face 94. The surface of each through hole 99 is irregularly shaped, and includes both a pair of opposed key slots 102 and a stop slot 116. The hub 74 has a stop surface 118 formed therein at a lower end of the stop slot 116.

Each mounting aperture 98 further includes a plurality of radially extending grooves 100 formed in the outer face 92 thereof. Each of the radial grooves 100 extends radially inwardly from the peripheral edge surface 96 so as to terminate at and communicate with a respective mounting aperture 98. In the illustrated embodiment, four poles 76 are provided for each hub 74, and thus each hub 74 includes four mounting apertures 98.

Each pole 76 consists of an elongate semi-rigid rod having a shaped hub end 164 for mounting within the mounting apertures 98, and a distal end 166 opposed to the hub end 164. The rod may be made of a strong, flexible material such as plastic, a carbon composite tube, or fiberglass. The hub end 164 of each pole 76 includes a transversely extending pin which forms a key 110 positioned adjacent to the terminus of the hub end 164, and also includes a narrow, outwardly extending stop 114 formed on the terminus of the hub end 164. During assembly and in use, the key 110 is received within and pivotably supported by the key slots 102 of the through hole 99. Likewise, the stop 114 is supported by the stop surface 118 in the stop slot 116 of the through hole 99.

Figure 8:
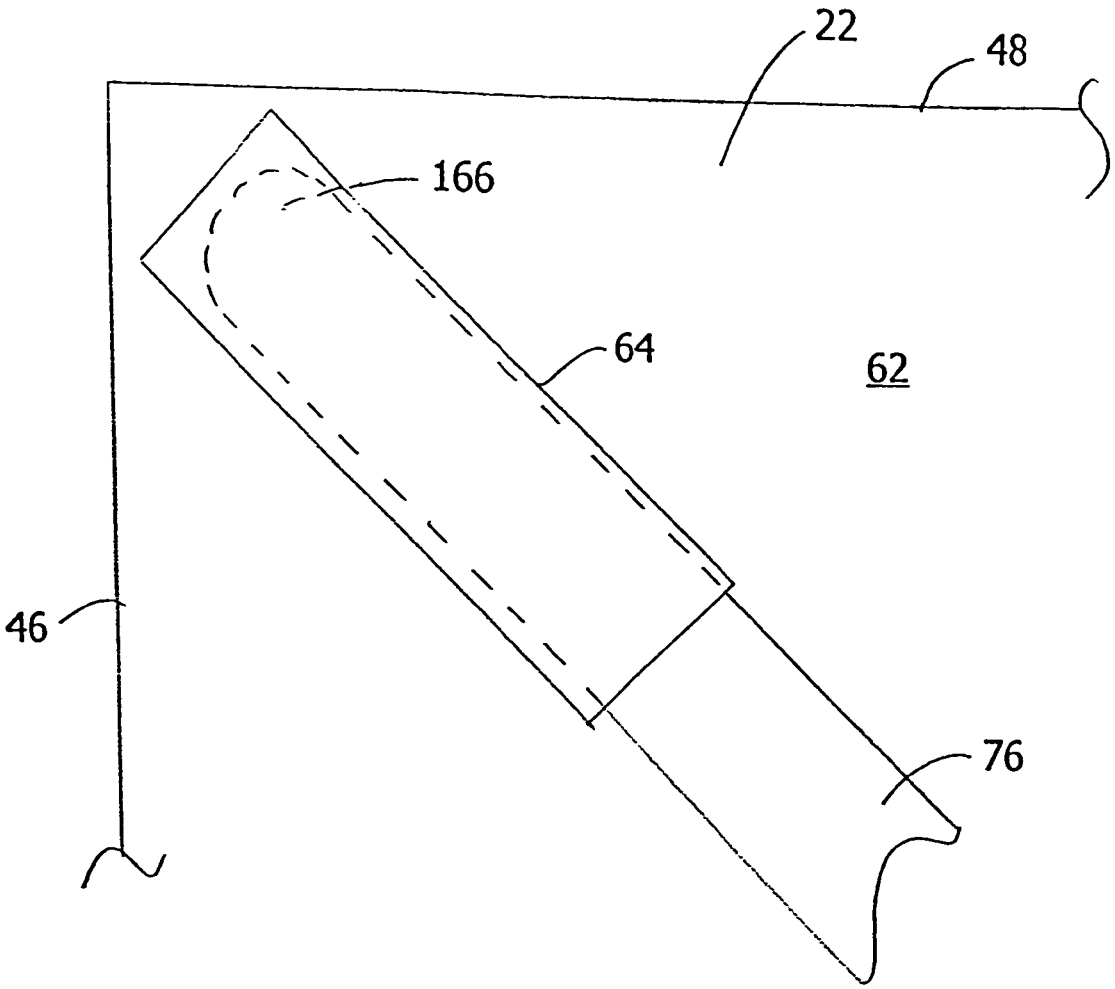
FIG. 8 is a detail view of a corner of a sidewall of the structure of FIG. 3 as viewed from the inside of the shelter, showing the distal end of a pole secured to the inner surface of the covering by insertion within a pocket formed on the inner surface of the covering.

Once assembled, each pole 76 is positioned within the hub 74 such that the hub end 164 resides within a mounting aperture 98. Specifically, in the unfolded and opened position of the sub-frame 72 shown in FIGS. 5 and 7, the key 110 resides within the key slots 102, the stop 114 abuts the stop surface 118, and the hub end of the pole 76 resides within a corresponding radial groove 100. In this fully opened configuration, the body portion 108 of the pole 76 extends radially outwardly from the peripheral edge surface 96 of the hub 74 (FIG. 7). The distal ends 166 of each pole 76 are received within elongate pockets 64 formed on the interior surfaces of the cover 20 of each sidewall 22. In the illustrated embodiment, each sidewall 22 is provided with four pockets 64 such that one pocket 64 is disposed adjacent each corner of the sidewall 22 and oriented substantially diagonally thereon (FIG. 8).

Once the hub ends 164 of the poles 76 are positioned within the respective mounting apertures 98, the inner face 94 of the hub 74 is covered with a circular metal hub cap 104. The hub cap 104 includes a central hole 103, which aligns with a threaded bolt hole 120 formed through the axial centerline of the hub 74. The hub cap 104 is maintained on the inner face 94 of the hub 74 using a threaded bolt 106, extending through both the central hole 103 of the washer 104 and the bolt hole 120 of the hub 74, and secured with a nut 105. The outer end of the bolt 106 is looped to form an eye 135.

Eye 135 provides a means for grasping the hub 74, and may support a short pull strap to enhance that function. In FIG. 6, the eye 135 of the bolt 106 is illustrated as disposed adjacent the inner face 94 of the hub 74. However, as shown in FIG. 16, the hub 74 will function equally well when the bolt 106 is inverted so that nut 105 is disposed adjacent to the inner face 94 of the hub 74.

In the preferred embodiment, the eye 135 of the bolt 106 is located on the outer surface of the portable enclosure 10, and provides an attachment structure to which an end of an adjustable cinch strap is secured. A cinch strap 156 is secured between the structurally substantial hub 74, via the eye 135, and the substrate 5, via an anchor stake 230 described below. This configuration is provided on each sidewall of the enclosure, so that each sub-frame 72 is individually fixed to the substrate 5.

Figure 16:
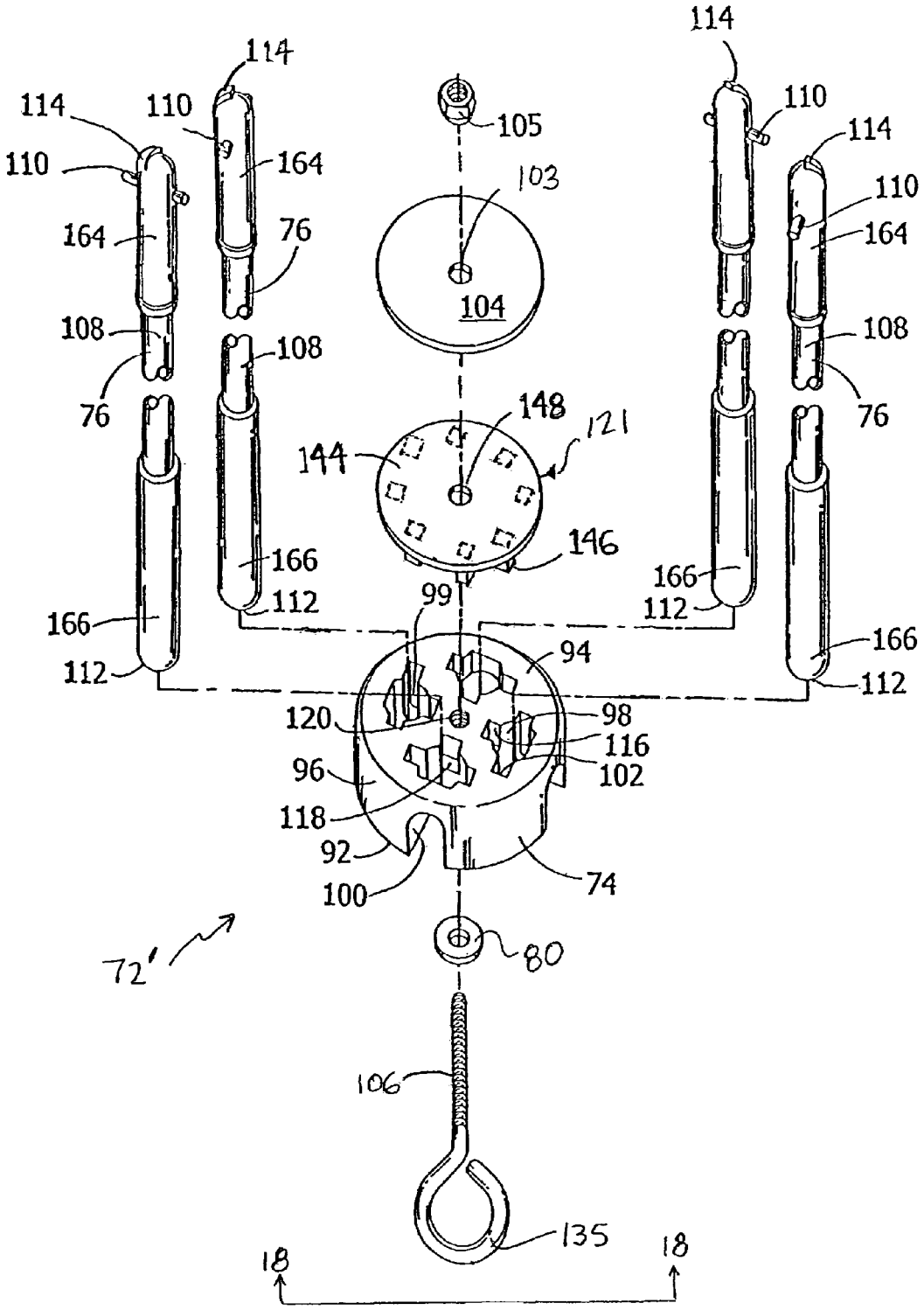
FIG. 16 is an exploded detail view of a second embodiment sub-frame, showing a strut stabilizer for stabilizing the poles within the hub, the strut stabilizer maintained on the hub face between the hub body and the hub cap using a bolt.
Figure 17:
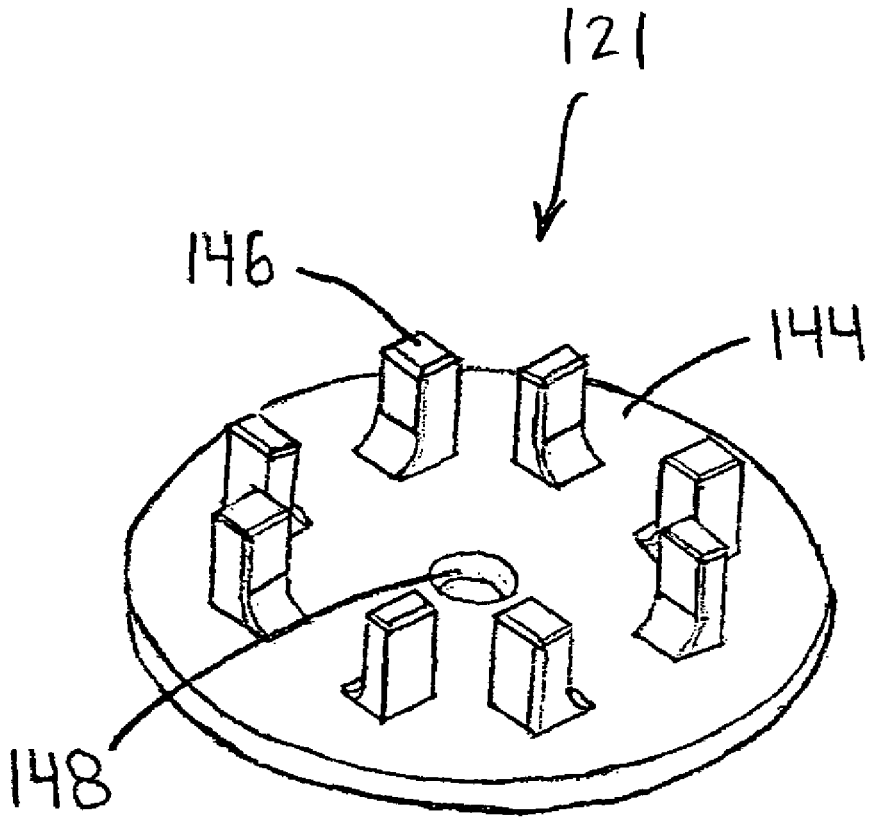
FIG. 17 is a detail perspective view of a strut stabilizer which is a component part of the sub frame of FIG. 16.
Figure 18:
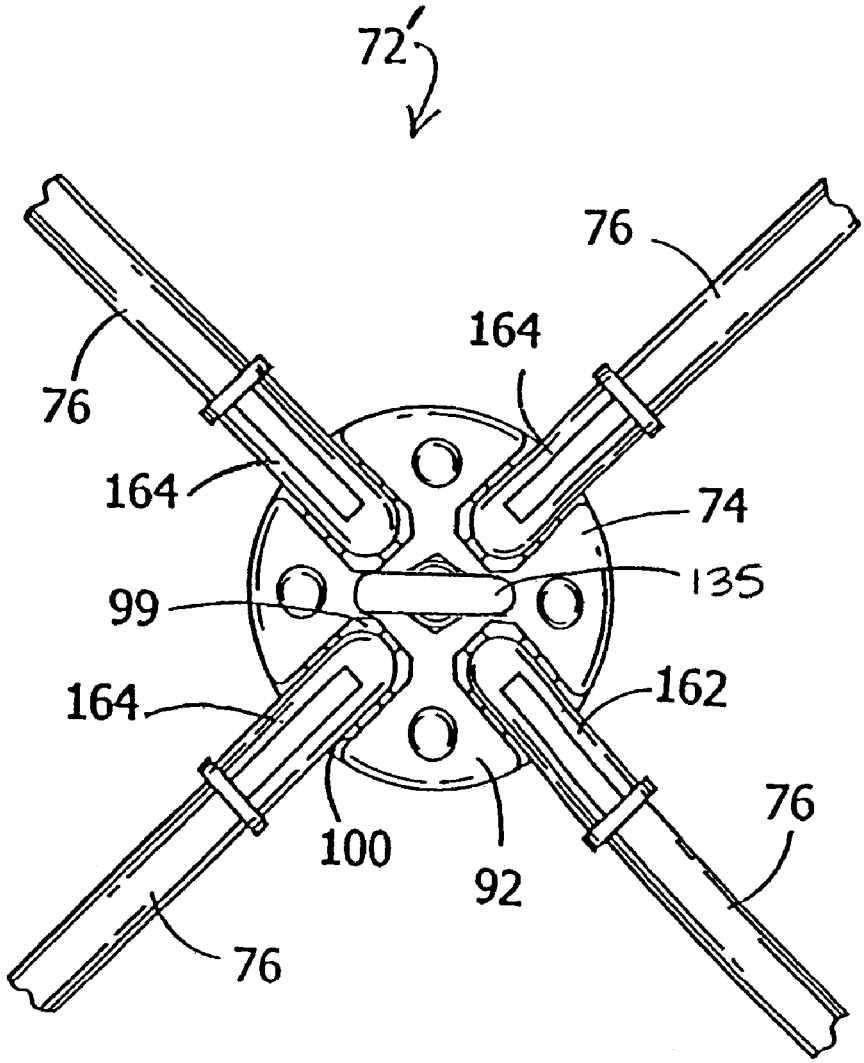
FIG. 18 is a detail view along line 18-18 of the assembled and erected hub portion of the improved sub-frame of FIG. 16.

An improved embodiment of the sub-frame 72' is depicted in FIGS. 16 and 17. The improved embodiment of the sub-frame 72' is substantially similar to the sub-frame 72 described above, and therefore elements common to both embodiments employ common reference numbers and descriptions. As in the embodiment described above, the improved sub-frame 72' includes a central hub 74 with struts 76 extending therefrom.

In the improved embodiment sub-frame 72', a strut stabilizer 121 is used to improve the function and reliability of the sub-frame 72.' As seen in FIG. 16, the threaded bolt 106 is used to secure the strut stabilizer 121 to the outer face 94 of the hub 74. In particular, the threaded end of the bolt 106 passes through a small diameter washer 80, the threaded center hole 120 of the hub 74, the strut stabilizer 121, and the hub cap 104, and is secured thereon with a nut 105.

The strut stabilizer 121 limits movement of the poles 76 in the hub mounting apertures 98, and also applies pressure to the keys 110 formed in the hub ends 164, thereby stabilizing the poles 76 relative to the hub 74 and permitting smooth movement of the poles 76 within the hub 74. The strut stabilizer 121 includes a circular plate 144 formed of molded plastic that has a plurality of integrally formed pin-engaging protrusions 146 on one side thereof. There are two protrusions 146 for each pole, with one protrusion 146 provided for each pin 110. The protrusions 146 are molded to interlock with key slots 102 of each through hole 99, to contact the keys 110, and to limit movement of the keys 110 in the hub assembly. The hub cap 104 acts as a large reinforcing washer and evenly distributes the pressure of the nut to the strut stabilizer 121.

Tensioning Straps

A tensioning strap 150 may, optionally, be provided on the interior surface 62 of the covering 20 for use with one or more panels thereof. Thus one or more of the sidewalls 22 and the ceiling 24 of the portable enclosure 10 may be provided with a tensioning strap 150. Each tensioning strap 150, where used, includes strap sections 152, 154 which extend between a pair of opposed edges of a respective portion of the covering 20, such as a sidewall 22 or ceiling 24. Each tensioning strap 150 also includes a tensioning mechanism 160, which joins strap sections 152, 154 at an approximately central location therebetween. The tensioning mechanism 160 can be of a conventional type similar to a known tensioning mechanism used in automotive safety belts, which allows a single-direction adjustment of the overall length of the straps 152, 154.

Figure 11:
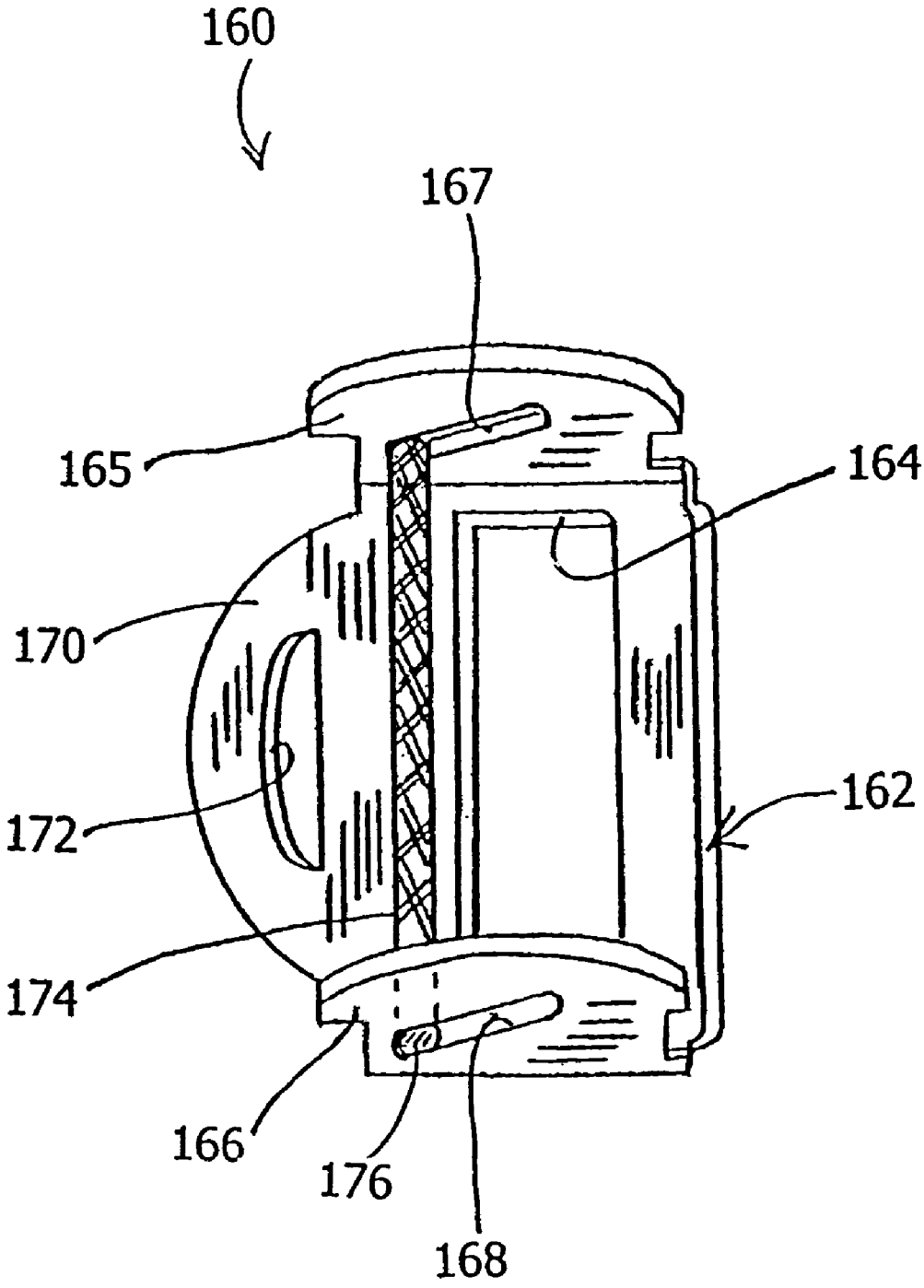
FIG. 11 is a perspective view of the tensioning mechanism isolated from the tensioning straps, showing the textured bar overlying the base plate.
Figure 12:
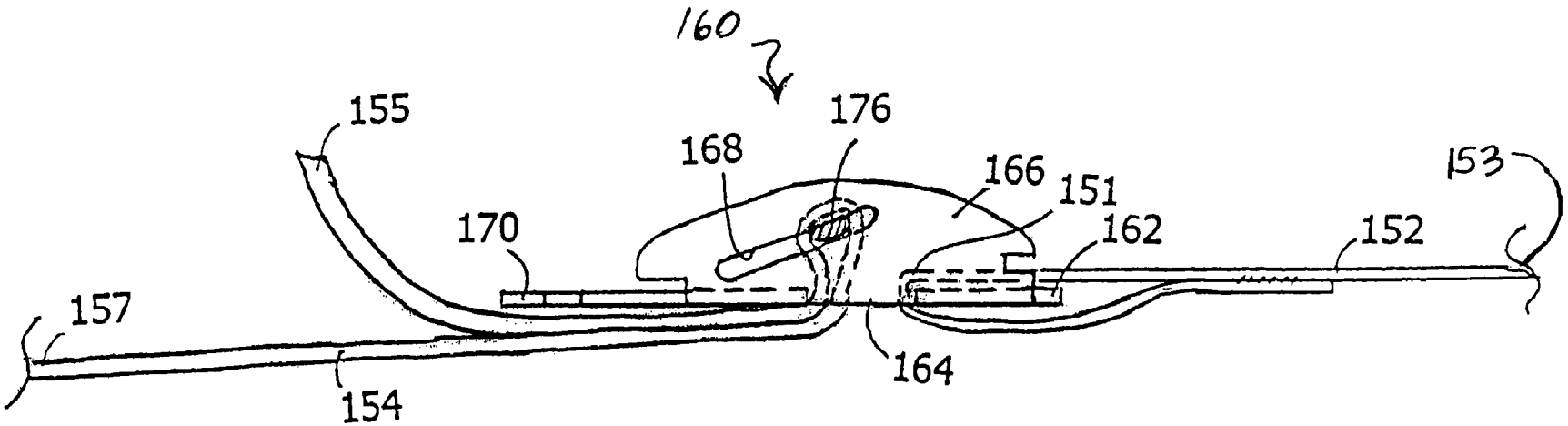
FIG. 12 is a side view of the tension-producing member, showing the tensioning straps extending from the tensioning mechanism.

The internal structure of one example of a tensioning mechanism 160 is shown in FIGS. 11 and 12. As seen in FIG. 11, the tensioning mechanism 160 includes a base plate 162 having parallel sides and having an opening 164 formed therein. A pair of opposed side flanges 165, 166 are integrally attached to and extend upwardly from the respective parallel sides of the base plate 162. Each of the side flanges 165, 166 has a respective slot 167, 168 formed therein, oriented at an upwardly sloping angle with respect to the base plate 162. The base plate 162 includes a release flange 170 having a hole 172 formed therein. If desired, a release strap may be secured to release flange 170 using the hole 172. The tensioning mechanism 160 further includes a textured bar 174 extending between the side flanges 165, 166, with the ends 176 of the bar 174 slidably disposed in the slots 167, 168 thereof. Although the inventive portable enclosure is described is illustrated using tensioning mechanism 160, it is within the scope of this invention to use other tensioning devices, such as, but not limited to, a ratcheting tensioner.

In the tensioning strap 150 according to the present invention, a first, adjustable length strap 154 is formed of a strong, flexible material. An example of such a material includes, but is not limited to, nylon webbing. Adjustable length strap 154 has opposed first and second ends 155, 157, and is pre-threaded through the tensioning mechanism 160. A user of the apparatus is not required to remove the adjustable length strap 154 from the tensioning mechanism 160, or to re-thread the adjustable length strap 154 therethrough at any time during the life of the mechanism, under normal circumstances.

The tensioning strap 150 further includes a second, fixed length strap 152 operatively attached to the adjustable length strap 154 via the tensioning mechanism 160. The fixed length strap 152 is formed of a strong, flexible material, similar to the material of the adjustable length strap 154. The fixed length strap 152 has opposed first and second ends 151, 153. The first end 151 of the fixed length strap 152 is operatively and non-adjustably attached to the tensioning mechanism 160. This may be accomplished by passing the end of the strap around the end of the base plate 162, through the opening 164, and sewing the strap back on itself, as shown in FIG. 11. The second end 153 of the fixed length strap is operatively and non-adjustably attached to the edge portion of the sidewall (or ceiling).

As seen in FIG. 12, the first end 155 of the adjustable length strap 154 is fed through the opening 164 in the base plate 162 in the direction shown, passed around the bar 174 in the direction of the release flange 170, and is then fed back through the opening 164. The first end 155 of the adjustable length strap 154 is allowed to hang freely. The second end 157 of the adjustable length strap 154 is operatively and non-adjustably attached to the edge portion of the sidewall (or ceiling) which is opposed to the edge portion upon which the second end 153 of the fixed length strap is secured. Thus as seen in FIG. 3, the tensioning strap 150 spans a respective portion of the covering, such as a sidewall 22 or ceiling 24, such that the strap members 152. 154 are fixed to opposed edges of the portion of the covering.

For example, in FIG. 3, a first tensioning strap 150' is shown on a sidewall 22 and a second tensioning strap 150" is shown on the ceiling 24. Although not shown, a tensioning strap 150 may be provided on additional sidewalls 22, as needed. With respect to the first tensioning strap 150' on the sidewall 22, the second end 153' of the fixed length strap 152' is fixed to the upper edge of the sidewall 22, and the second end 157' of the adjustable length strap 154' is fixed to the lower edge of sidewall 22. Similarly, with respect to the second tensioning strap 150" on the ceiling 24, the second end 153" of the fixed length strap 152" is fixed to a first lateral edge of the ceiling 24, and the second end 157" of the adjustable length strap 154" is fixed to an opposed lateral edge of the ceiling 24.

As seen in FIG. 3, adequate tension is provided by inversion of the sub-frames in the open assembled configuration thereof, so that the distal ends 166 of each pole 76 are flexed inwardly toward the center of the portable enclosure 10, and so that the hub is pressed outwardly, away from the center of the portable enclosure 10 and against the covering 20.

When setting up the enclosure 10, the distal ends of the poles are inserted into the corresponding pockets 64 at the corners of a selected sidewall panel 22, with the outer face 94 of the hub oriented facing outwardly, against the material of the sidewall. The hub is then pushed outwardly until it bows out past the corners of the sidewall 22, in a gently bowed configuration similar to an open, unfurled umbrella.

Cinch Straps

Figure 13:
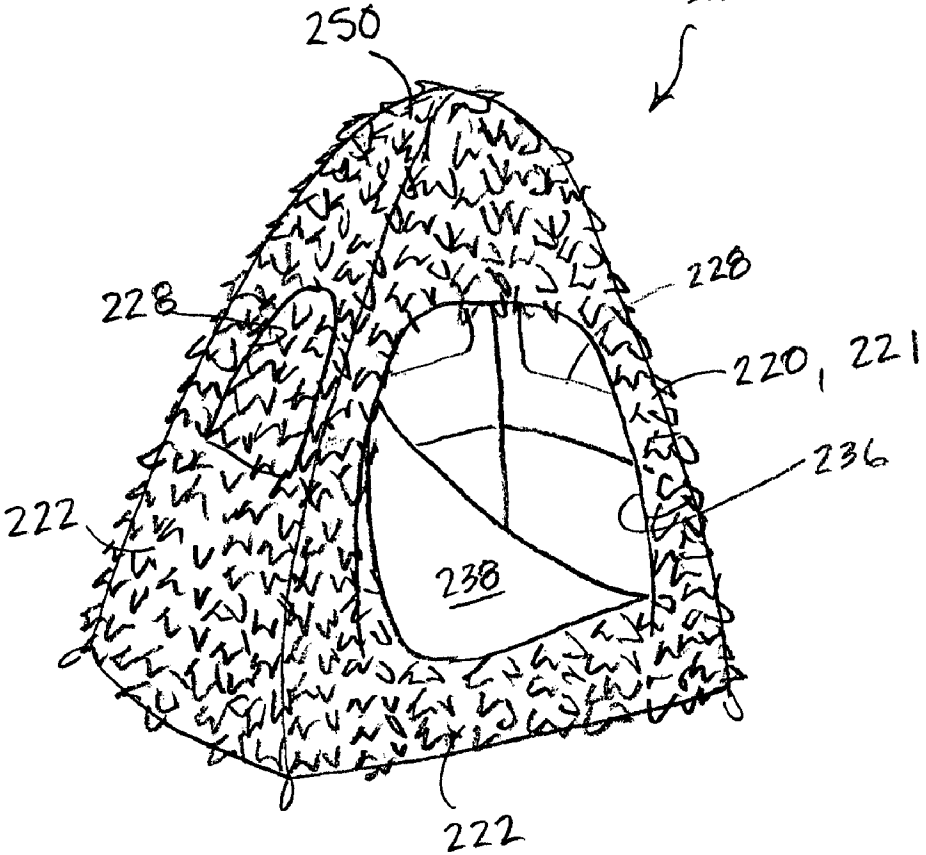
FIG. 13 is an elevated perspective view of an assembled portable outdoor structure according to another illustrative embodiment of the present invention, showing an alternative enclosure construction.

The adjustable cinch straps 156 extend from the frame 70 and are secured into the ice using anchor stakes 230 (described below). Like the tensioning straps 150 used on the interior of the enclosure 10, each adjustable cinch strap 156 comprises a fixed length strap 159, an adjustable length strap 158, and a tensioning mechanism 160 joining the fixed length strap 159 to the adjustable length strap 158. The tensioning mechanism 160 permits adjustment of the length of the cinch strap 156. Preferably, in use, the length of the cinch strap is sufficiently shortened so that a tension force is applied between the eye 135 and the stake 230, as shown in FIG. 13. Although the mechanism for adjusting strap length and tension is disclosed herein as tensioning mechanism 160, it is understood that use of other means of strap adjustment is within the scope of the invention.

One end of the cinch strap 156, for example the fixed length strap 159, is secured to the eye 135 of the bolt 160 by conventional means. In the illustrated embodiment, a loop is provided at the strap end, so that in use, the loop is passed through the eye and about the cinch strap 159 itself. The second end of the cinch strap 156, for example the adjustable length strap 158, is secured to the stake 230 by conventional means. In the illustrated embodiment, a loop is provided at the strap end, and in use, the loop is hooked about the handle 232 of the stake 230 in order to retain the cinch strap 156 thereon.

Anchor Stakes

Figure 9:
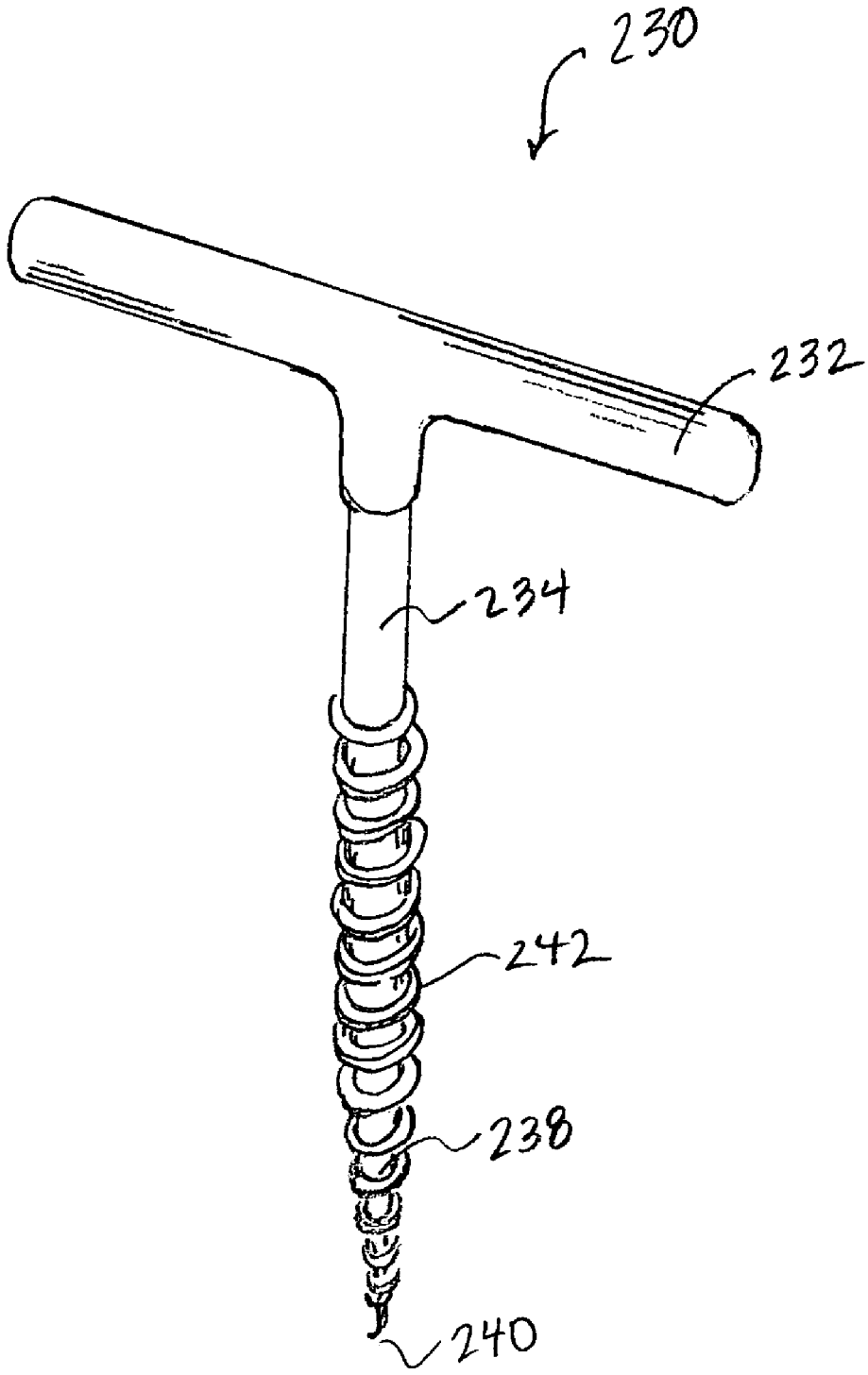
FIG. 9 is a perspective view of a stake used for attaching the structure of FIG. 1 to a supportive substrate, illustrating the threaded lower end and a T-shaped handle formed on the upper end.

The portable enclosure 10 is maintained in contact with the ground or other support surface 5 using a plurality of anchor stakes 230 (FIG. 9) which cooperatively engage one end of a cinch strap 156. The other end of the cinch strap 156 is attached to an external surface of the enclosure 10, whereby the enclosure 10 is secured to the substrate 5.

Each anchor stake 230 comprises an elongate shank 234. The upper end of the shank 234 is shaped to form a handle 232. The handle is sized and shaped to allow adequate gripping and leverage for manual rotation of the anchor stake during use. In the illustrated embodiment, the handle is an elongate bar disposed on the upper end of the shank 234 to form a T. However, it is well within the scope of this invention to form the handle having other shapes. The handle may be provided with an insulative covering, such as rubber or a suitable elastomeric coating, for improved comfort and grippability when used in cold environments.

Figure 10:
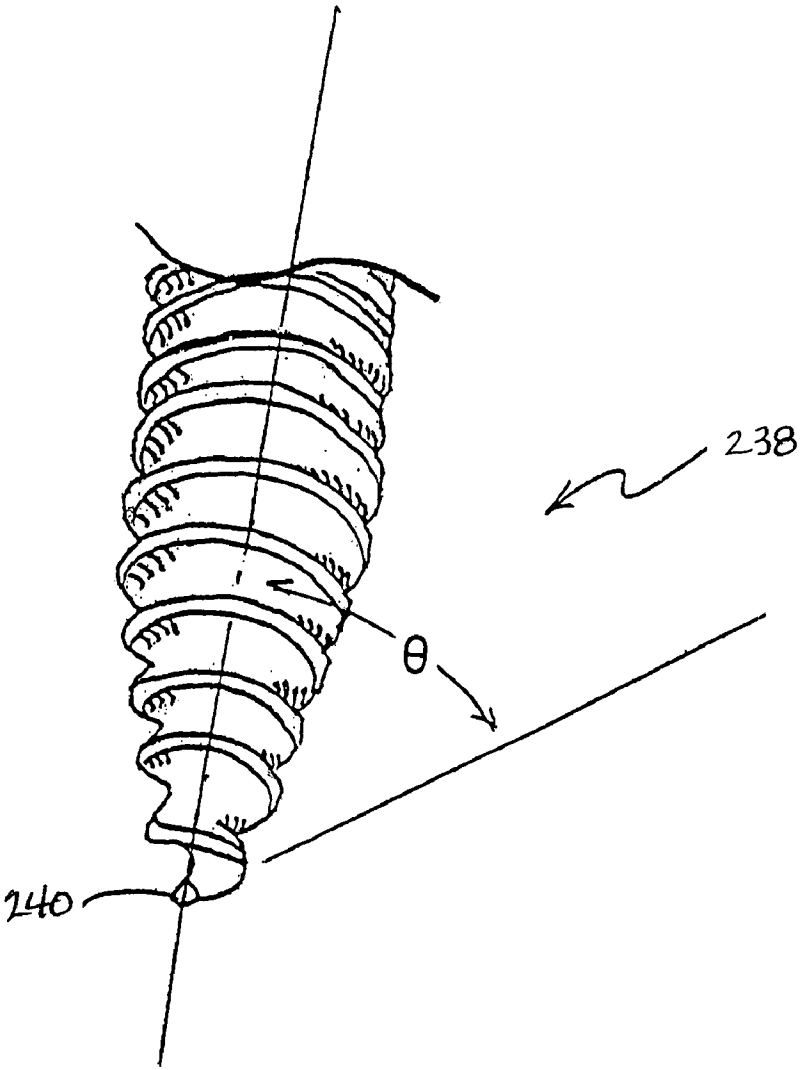
FIG. 10 is a detail view of the of the lower tip end of the stake of FIG. 8, showing the helical shape of the lower end, and the angle θ of the terminal tip relative to the longitudinal axis of the stake.

The lower end 238 of the shank 234 is tapered, and terminates in a pointed tip 240. For ease of threading into a hard or compacted surface 5, the tapered portion may be two inches or more in length. The lower end 238 is provided with coarse exterior threads 242, and at the tip 240 the shank 234 is provided with a generally helical shape, in the manner of a corkscrew. As a result, the tip 240 is oriented at an angle θ relative to the longitudinal axis of the shank 238 (FIG. 10). This configuration of the shank 234, wherein the outer surface is threaded and the tip 240 is angled, are features which allow the anchor stake 230 to be manually screwed into hard or compacted surfaces 5 with only moderate effort.

SECOND EMBODIMENT

Figure 14:
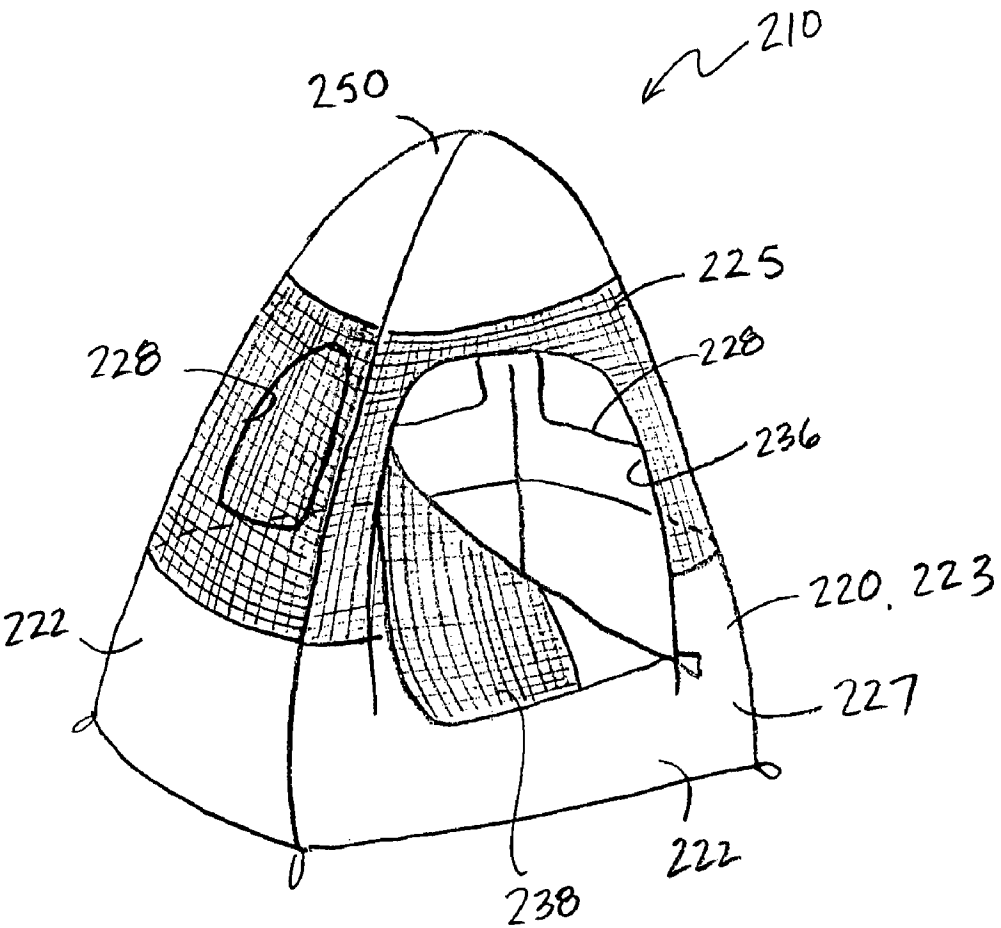
FIG. 14 is an elevated perspective view of the assembled portable outdoor structure of FIG. 13, showing the substrate of the cover with the outer layer omitted, revealing the upper portions of the sidewall formed of a frangible mesh which permits a 360 degree range of view in the horizontal plane as well as shoot through capability.
Figure 15:
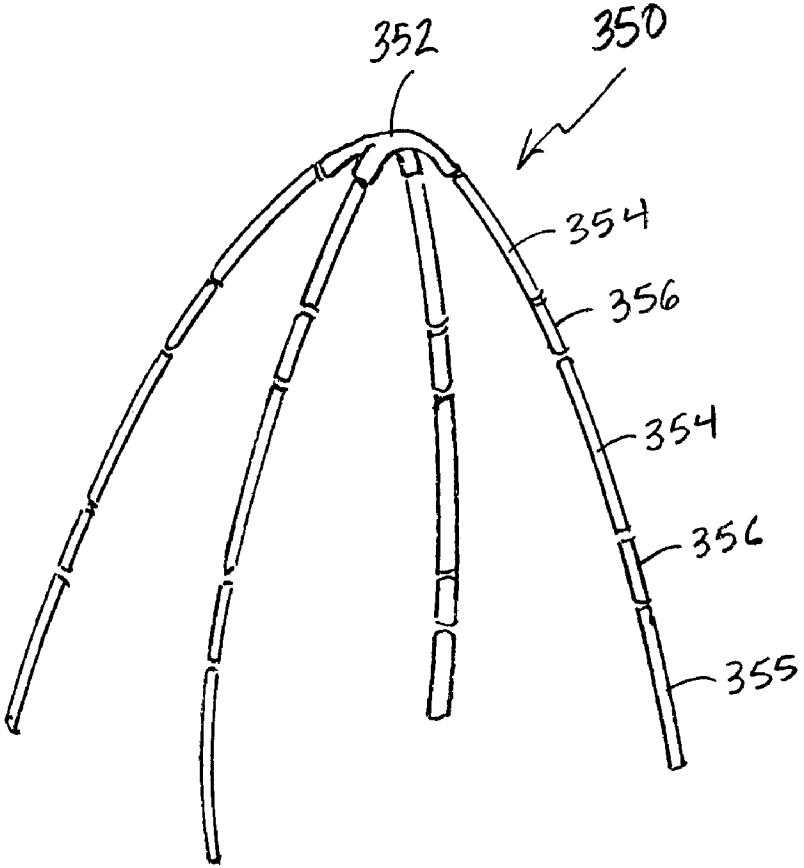
FIG. 15 is an elevated perspective view of a frame structure for the enclosure of FIG. 13, with the covering deleted from the drawing for illustrative purposes.

As shown in FIGS. 13-15, in a fully assembled configuration thereof, a portable enclosure 210 according to another illustrative embodiment of the present invention includes a flexible covering, or shell, 220 supported by a frame 350 (FIG. 15), and secured to a supportive substrate 5 using a plurality of anchor stakes 230.

The covering 220 is cooperatively supported by the frame 350, which may be erected from a collapsed storage configuration either inside or outside of the covering. The covering 220 for the portable enclosure 210 is formed of flexible sheet material, which may be nylon or another woven synthetic fabric to provide the durability, flexibility and strength required for use in harsh environmental conditions.

The covering 220 includes a plurality of interconnected sidewalls 222. The sidewalls 222 are arranged in a lateral edge-to-edge relationship, such that each of the sidewalls 222 is joined to an adjacent sidewall at each of its respective lateral edges, to form a substantially closed section. In the embodiment of FIG. 13, each of the sidewalls 222 making up the covering 220 has a substantially arch-shaped outline, similar to an inverted parabola, as shown, and are mutually connected at an upper end to close the extreme upper side 250 of the enclosure 210, giving the overall structure a modified dome shape.

The lower end of the portable enclosure 210 may be left open to allow the user to have access to substantially the entire ground surface area within the surrounding sidewalls. Alternatively, if desired, a bag used to house and store the enclosure 210 in a collapsed configuration thereof may be adapted to be used as a floor in the assembled configuration of the enclosure 210, to cover part or all of the floor area inside of the enclosure 210.

Covering

In a manner similar to that of the first embodiment, the covering 220 of the enclosure 210 is a unitary body configured to provide four sidewalls 222. The covering 220 provides an outer shell for the portable enclosure 210, and is formed of a bi-layer flexible sheet material. In the illustrated embodiment, each layer of the bi-layer flexible sheet material is a woven synthetic fabric to provide the durability, flexibility and strength required for use in harsh environmental conditions.

The covering 220 includes a three-dimensional camouflage outer layer 221 (FIG. 13). The three-dimensional elements of the camouflage are partial cutouts in an outer layer of camouflage fabric. The camouflage outer layer is attached to a non-cut substrate (inner layer) 223. The exterior-facing surfaces of both the outer layer 221 and substrate 223 are printed in a camouflage pattern and coloration. In the outer layer 221, the partial cutouts are formed with a realistic curvilinear incision pattern resembling tree leaves. The partial cutouts of the outer layer 221 dangle off of the face of the substrate 223 providing a desirable 3-D effect. This effect is enhanced in breezy conditions, since the free ends of the partial cutouts move freely relative to the substrate 223. The outer layer 221 is formed of a conventional durable fabric such as a rip-stop nylon.

The cover 220 is shown in FIG. 14 with the outer layer 221 deleted for the purpose of illustrating the configuration of the inner layer 223. However, it is understood that in actual use, the outer layer 221 and inner layer 223 are permanently fixed to one another, for example by sewing.

As seen in FIG. 14, the inner layer 223 comprises a transparent upper portion 225 which substantially extends over the upper half of the sidewalls 222. The upper portion 225 is rendered semi-transparent when the camouflage outer layer 221 is superimposed on the inner layer 223. The upper portion 225 is formed of a frangible mesh having a size and thickness which permits "shoot through" of the discharge of a hunting weapon such as a bow or gun. The upper portion 225 extends continuously across the sidewalls 222 to provide a portable enclosure 210 having a high degree of unidirectional (outward) visibility over a 360 degree range and also provides "shoot through" capability over the entire viewing range.

The inner layer 223 also includes a lower portion 227 which extends between the upper portion 225 and the lower edge of the cover 220. The lower portion 227 is opaque, and formed of a conventional durable fabric such as a rip-stop nylon.

In the illustrated embodiment of FIG. 14, the mesh upper portion 225 extends only to a predetermined height along the sidewalls 222, and the extreme upper end 250 of the enclosure 210 is formed of an opaque inner layer 223 in a manner similar to that of the lower portion 227. Such a configuration would provides protection for the occupant from rainfall. The predetermined height corresponds at least to a height which was higher than eye level of a seated adult occupant. Alternatively, the mesh upper portion 225 may extend continuously to the extreme upper end 250 of the enclosure 210 (this configuration is not shown).

At least one window opening 228 may be disposed on one or more of the sidewalls 222. Each window opening comprises a window flap which is releasably connected about its peripheral edge to the corresponding sidewall 222. For example, a zipper may be provided along the peripheral edge of the window opening 228 to permit selective opening and closure of the window opening 228. The window openings 228 may be formed in the upper portion, the lower portion, or extending across both the upper and lower portions. The window opening 228 extends through both layers 221, 223 of the cover 220 so that when the window opening 228 is opened, the space within the window opening is vacant, and a single flap 229 is formed of the bi-layer fabric cover 220.

Although the inventive portable enclosure 210 is illustrated as having a plurality of window openings 228, it should be understood that outward visibility over a 360 degree range is unrelated to the number of window openings 228, and/or whether the window openings 228 are open or closed. Rather, outward visibility over a 360 degree range is achieved as a result of the full-surround configuration of the upper portion 225.

The portable enclosure 210 includes at least one selectively closable door opening 236 formed in a sidewall 222, to permit ingress into, and egress from the enclosure 210. In the depicted embodiment, the door opening 236 is a closable door flap 238 that is secured to the sidewall 222 using conventional door closure means (not shown), which may include, but is not limited to, hook and loop fasteners, zippers, snaps, or ties. The door opening 236 is of sufficient size to extend across both the upper portion 225 and the lower portion 227 of the covering. Like window opening 228, the door opening 236 extends through both layers 221, 223 of the cover 220 so that when the door opening 236 is opened, the space within the door opening is vacant, and a single flap 238 is formed of the bi-layer fabric cover 220.

A vent opening (not shown) may be formed in the extreme upper end of the enclosure 210, and may comprise a breathable vent insert sewn therein which prevents environmental precipitation from entering into the interior of the enclosure 210, and which also allows adequate ventilation of the structure. The vent opening may include a closable flap of fabric on the interior of the covering 220, and a screen panel may be provided as the vent insert.

Frame

The support frame 350 for the enclosure of FIGS. 13 and 14 is illustrated in FIG. 15, and includes a central connector 352. In the embodiment of FIG. 15, the central connector 352 is X-shaped. A plurality of interconnecting poles 354, 355 are used together with the central connector 352 to construct the frame 350. The poles 354, 355 are made of strong, semi-flexible fiberglass or plastic material, and some of the poles 354 have integral sleeves 356 to receive an end of another pole therein.

It will be understood that suitable fabric or elastic loops may be provided on the interior or the exterior upwardly extending seams of the covering, to receive the frame pole sections 354, 355 therein.

Although the presently contemplated embodiments of a portable enclosure for use in have been described herein, the foregoing description is intended to illustrate, rather than to limit the invention. Those skilled in the art will recognize that various substitutions and modifications can be made, without departing from the invention. All such modifications, which are within the scope of the appended claims, are intended to be within the scope and spirit of the present invention.

Having, thus, described the invention, what is claimed is:

1. A portable outdoor enclosure, comprising:

a covering comprising a ceiling portion and a plurality of interconnected side walls, with each of the side walls being connected to the ceiling portion, and a support frame that defines a plurality of sidewalls and supports the covering thereon;

each of the side walls of the covering comprising an inner layer and an outer layer configured to permit an occupant of the interior of the enclosure to view, through the covering, the exterior of the enclosure substantially over a 360 degree range in a horizontal plane, the outer layer further configured to substantially prevent an observer positioned exteriorly of the enclosure to view the occupant;

wherein the outer layer comprises a fabric material which is attached to the inner layer at a plurality of attachment locations, the outer layer having a camouflage pattern on an exterior surface thereof;

wherein the outer layer is partially cut in a three-dimensional pattern between the attachment locations to define a plurality of partial cutouts thereon;

and wherein the inner layer comprises an upper portion comprising a mesh substrate and a substantially opaque lower portion.

2. The portable outdoor enclosure of claim 1 wherein the support frame comprises a plurality of sub-frames cooperating to form the support frame, wherein one of the sub-frames is disposed on each sidewall, and wherein each sub-frame is provided with a central hub having support poles extending radially outward therefrom.

3. The portable outdoor enclosure of claim 2, wherein each sub-frame is provided in a size which is slightly larger than the dimensions of its corresponding sidewall, such that when erected, the support poles bow outwardly from the natural plane of the sidewall to a self-supporting locked position thereby providing tension to the sidewall.

4. The portable outdoor enclosure of claim 1, wherein the upper portion of the inner layer also has a camouflage pattern thereon.

5. The portable outdoor enclosure of claim 1, wherein the mesh substrate extends substantially 360 degrees around the interior of the covering in a horizontal direction to define a see-through band.

6. A portable outdoor enclosure comprising a camouflage cover supported by a selectively collapsible frame, the enclosure comprising a closed-wall structure comprising a ceiling panel and a plurality of interconnected side walls, with each of the side walls being connected to the ceiling panel such that an occupant of the enclosure is surrounded on all sides by the walls of the enclosure, the camouflage cover comprising a plural-layer construction having at least an inner and an outer layer which permits a substantially complete 360 degree view of the exterior of the enclosure when viewed from the interior of the enclosure, and which substantially prevents a view of the interior of the enclosure when viewed from the exterior of the enclosure, the outer layer comprising a plurality of partial cutouts which are partially separable from the inner layer, wherein the outer layer is attached to the inner layer at a plurality of spaced locations, and wherein the exterior-facing surfaces of both the outer layer and the inner layer are printed in a camouflage pattern and coloration.

7. The portable outdoor enclosure of claim 6, wherein the camouflage cover comprises a first portion, the first portion extending about a horizontal perimeter of the structure, the first portion configured to substantially permit a substantially complete 360 degree view through the first portion of the cover, and wherein the camouflage cover comprises a second portion disposed adjacent to the first portion, the second portion configured to be visually opaque.

8. The portable outdoor enclosure of claim 7, wherein the first portion comprises an upper portion of the inner layer, and wherein the second portion comprises a lower portion of the inner layer.

9. A portable outdoor enclosure, comprising a selectively collapsible frame comprising a plurality of cooperating sub-frame assemblies, wherein each sub-frame assembly includes a plurality of interconnected frame elements;

a camouflage cover supported by the frame defining a roof and a plurality of interconnected sidewalls surrounding an enclosed space, the camouflage cover formed with a multi-layer construction having at least an inner and an outer layer which permits a substantially 360 degree view of an area external of the enclosure when viewed from the interior of the enclosure, and which substantially obstructs a view of the interior of the enclosure when viewed from the exterior of the enclosure, the inner layer comprising an upper portion comprising a mesh substrate and a substantially opaque lower portion, wherein the outer layer includes a plurality of partial cutouts, the cutouts formed in a shape to resemble tree leaves, the cutouts partially separable from the inner layer, wherein the outer layer is attached to the inner layer at a plurality of spaced locations, and wherein the exterior-facing surfaces of both the outer layer and the inner layer have a camouflage pattern and coloration thereon.

10. The outdoor enclosure of claim 5, wherein the mesh substrate extends substantially 360 degrees around the interior of the covering in a horizontal direction to define a see-through band.

* * * * *